United States Patent [19]

Hornung

[11] Patent Number: 4,460,163

[45] Date of Patent: Jul. 17, 1984

[54] DEVICE AND FURNACE FOR DISCHARGING MEASURED QUANTITIES OF MOLTEN METAL

[75] Inventor: Karl-Otto Hornung, Hombrechtikon, Switzerland

[73] Assignee: Stopinc Aktiengesellschaft, Baar, Switzerland

[21] Appl. No.: 475,922

[22] Filed: Mar. 16, 1983

Related U.S. Application Data

[63] Continuation of Ser. No. 227,980, Jan. 23, 1981, abandoned.

[30] Foreign Application Priority Data

Jan. 24, 1980 [CH] Switzerland ..... 562/80

[51] Int. Cl.[3] ..... C21C 5/52; B22D 39/02; B22D 39/06; C21D 11/00

[52] U.S. Cl. ..... 266/95; 266/96; 266/236; 222/590; 222/591; 222/595

[58] Field of Search ..... 266/94, 96, 95, 236; 222/64, 590, 591, 595, 596; 164/156

[56] References Cited

U.S. PATENT DOCUMENTS

| | | | |
|---|---|---|---|
| 2,937,789 | 5/1960 | Tama | 266/97 X |
| 3,439,759 | 4/1969 | Rouanet et al. | 266/236 X |
| 3,441,261 | 4/1969 | Sommer | 266/94 X |
| 3,591,052 | 7/1971 | Nef | 222/64 |
| 3,605,863 | 9/1971 | King | 164/156 |
| 3,918,613 | 11/1975 | Shapland | 266/236 X |
| 3,971,547 | 7/1976 | Fredrikson et al. | 266/236 |
| 4,268,016 | 5/1981 | Eschner et al. | 266/236 |

*Primary Examiner*—T. Tung
*Assistant Examiner*—Nathan Thane
*Attorney, Agent, or Firm*—Wenderoth, Lind & Ponack

[57] ABSTRACT

A holding or smelting furnace for discharging measured quantities of molten metal includes a furnace wall defining a furnace chamber adapted to contain molten metal having an upper free melt level, and at least one melt outlet channel extending from the furnace chamber through the furnace wall at a level below the free melt level. A sliding gate valve is mounted on the furnace wall at the outlet channel and is movable between a closed position blocking the outlet channel and an open position unblocking the outlet channel. Control structure maintains the free melt level at a constant level within the furnace chamber, and thereby maintains the hydrostatic pressure of the molten metal within the furnace chamber at a constant value during discharge of the molten metal. Regulating structure is operable independently of the operation of the control structure and moves the sliding gate valve between the closed and open positions thereof at a predetermined timed cycle.

22 Claims, 2 Drawing Figures

16
15

18
14
7
12
5
13
3
3
5
17
h
4
6
10
11
2
36
8
37

34
25
23
32
33
24
h
22
28
27
26
31
30

DEVICE AND FURNACE FOR DISCHARGING MEASURED QUANTITIES OF MOLTEN METAL

BACKGROUND OF THE INVENTION

This application is a continuation of now abandoned application Ser. No. 227,980, filed Jan. 23, 1981.

The present invention relates to a furnace, such as a holding or smelting furnace, for discharging measured quantities of molten metal, particularly non-ferrous molten metal.

For pouring measured quantities of molten metal, especially non-ferrous molten metal such as aluminum melts, from holding or smelting furnaces, devices are known whereby the melt is fed through an upwardly inclined trough having at its upper end a runover or overflow, and out of the furnace tank or chamber. Various arrangements are known for feeding the melt through the upwardly inclined trough to flow over the runover or overflow. Such arrangements may include compressed gas fed from a pressure vessel, a displacement float extending into the furnace chamber, or an electromagnetic feed arrangement. In such known arrangements wherein the melt is fed upwardly through a trough to overflow from the furnace, however, a relatively large quantity of the total melt, compared to the quantity or weight of the melt to be discharged, for example to be cast, must be set in motion during each casting cycle. This leads to a considerable degree of wave motion being imparted to the melt during each casting cycle. Particularly with a rapid casting cycle and with small quantities of melt to be cast, accurate measurement of the amount of molten metal to be discharged is extremely difficult, and very high demands are placed upon whatever control devices are employed. Additionally, it is effectively impossible to prevent impurities from floating on the upper surface of the melt, for example oxides forming on the upper surface of the melt during intervals between the casting operation. In the known casting arrangements, it is impossible to effectively prevent such impurities from overflowing and being discharged with the melt, whereby such impurities end up in the casting mold.

The above discussed inherent difficulties and disadvantages of overflow pouring arrangements occur to an even greater extent with tilting furnaces, whereby the discharge of accurately measured quantities of molten metal cannot be achieved, despite expensive designs.

In another known arrangement for discharging measured quantities of molten metal, for example in charging die-casting machines, ladle devices are employed. In this arrangement, a ladle fastened on a swivel arm serves both for measuring and for transporting the melt from the furnace chamber or tank to the casting machine or casting mold. Such ladles devices are however mechanically complex and bulky and operate on relatively long cycle times.

SUMMARY OF THE INVENTION

With the above discussion in mind, the object of the present invention is to provide an improved furnace, such as a holding or smelting furnace, for discharging measured quantities of molten metal, particularly non-ferrous molten metal, while overcoming the disadvantages of the prior art.

A further object of the present invention is to provide a device for use with a holding or smelting furnace for discharging from the furnace measured quantities of molten metal, particularly non-ferrous molten metal, while overcoming the prior art disadvantages.

A still further object of the present invention is to provide such a furnace and device whereby it is possible to achieve an accurate distribution of a desired quantity of melt directly into a casting mold or, for example, into die-casting machines, particularly for casting operations involving relatively small casting quantities and rapid casting cycles for achieving casting of shaped castings, and with relatively low expenditure on construction and control equipment.

The above objects are achieved, in accordance with one aspect of the present invention, by the provision of a furnace, such as a holding or smelting furnace, including a furnace chamber adapted to contain therein molten metal having a free melt level. A melt outlet extends from the chamber at a level below the free melt level to allow discharge of the molten metal from the chamber. A sliding gate valve is mounted adjacent the melt outlet for covering and uncovering the melt outlet to thereby respectively block and unblock discharge of molten metal from the chamber. A control device is provided for maintaining the free melt level at a constant level within the furnace chamber during discharge therefrom of the molten metal. By maintaining the free melt level at a constant level within the furnace chamber, it is possible to maintain the hydrostatic pressure of the molten metal within the furnace chamber at a constant value during discharge of the molten metal. At a given constant level of the free melt level, and with a given temperature and viscosity of the melt, the amount of discharge of molten metal per unit time through an outlet nozzle of the sliding gate valve of a given size will be constant. Thus, it is possible to accurately discharge measured quantities of molten metal.

The furnace may be an electric resistance heated furnace with electric resistance heating devices in the furnace lining. Also, the furnace may include an induction furnace having a channel-type inductor heating device. The furnace may have extending from a side thereof an extension having a configuration similar to a conventional pouring spout having a floor, and the melt outlet and the sliding gate valve may be arranged at such floor. Additionally, the melt outlet and the sliding gate valve may be arranged at the base of the furnace chamber.

In accordance with a further aspect of the present invention, there is provided a device for discharging measured quantities of molten metal from a furnace having a furnace chamber and a melt outlet. Such device includes a sliding gate valve adapted to be mounted adjacent the melt outlet of the furnace for covering and uncovering the melt outlet and for thereby respectively blocking and unblocking the discharge of molten metal from the furnace chamber, and a control device for maintaining the free melt level of the molten metal within the furnace chamber at a constant level above the melt outlet during discharge of the molten metal.

The furnace and device according to the present invention may further include a regulating device, operable independently of the operation of the device for controlling the level of the molten metal, for operating the sliding gate valve between the closed and open positions thereof at a predetermined timed cycle. Such regulating device may include a gate drive for driving the sliding gate valve and a timing arrangement for controlling operation of the gate drive at a predetermined time cycle.

The control device for maintaining the constant level of the molten metal may include a liquid-level displacement float extending into the molten metal within the furnace chamber, a drive arrangement connected to the float for varying the degree of extension of the float into the molten metal, and a level detector positioned within the furnace chamber for detecting the level of the free melt level and connected to the drive arrangement for initiating operation thereof as a function of the level detected by the level detector, to thereby vary the degree of extension of the float into the molten metal to maintain the free melt level at the desired constant level. There may additionally be provided baffles within the molten metal in the furnace chamber to prevent agitation of the upper free melt level of the molten metal during variation of the degree of extension of the float into the molten metal.

In accordance with a further feature of the present invention, the sliding gate valve includes structure for varying the size of the discharge opening thereof. Such structure may include interchangeable discharge nozzles of different size. Alternatively, such structure may involve an arrangement whereby the discharge opening of the sliding gate valve may be operated to only partially open by varying degrees.

BRIEF DESCRIPTION OF THE DRAWINGS

Other objects, advantages and features of the present invention will be apparent from the following detailed description, taken with the accompanying drawings, wherein.

DETAILED DESCRIPTION OF THE INVENTION

Figure 1:
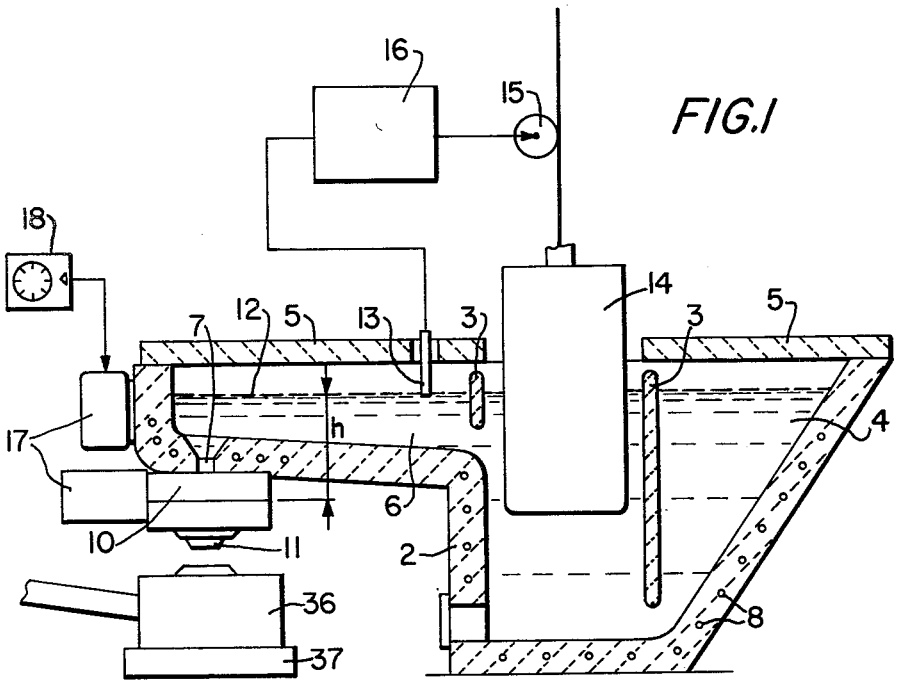
FIG. 1 is a somewhat schematic cross-sectional view illustrating a casting arrangement employing a furnace and device according to one embodiment of the present invention.

With reference now to FIG. 1, a first embodiment of the furnace and device of the present invention will be described in detail.

FIG. 1 illustrates an electric resistance heated furnace 2 having a wall or lining having therein electric resistance heating devices 8. Extending from a side of the furnace 2 is a structure in the form of a conventional pouring spout 6. The furnace 2 has an interior chamber which is loosely subdivided by partitions 3, to be discussed in more detail below, and includes a charging chamber 4. In an obvious modification of the arrangement illustrated in FIG. 1, there may be provided plural spouts 6 from the same furnace structure. The interior furnace chamber is preferably covered by means of loosely mounted lids 5 which do not form a tight seal, such that the upper free melt level 12 of the molten metal is under atmospheric pressure.

The floor of the pouring spout 6 has therethrough an outlet channel 7, and a sliding gate valve is mounted on the furnace to cover the outlet channel 7. The sliding gate valve 10 is shown schematically only, and may be of any known sliding gate valve structure, providing for either linear or rotary sliding movement of the sliding plate. As indicated schematically in FIG. 1, the lining of furnace 2 may have concentrated electric resistance heating devices 8 around the area of outlet channel 7 to prevent solidification of the melt in the area of the channel and the sliding gate valve. As would be obvious to one skilled in the art, it would alternatively be possible to operate the furnace heating operation by means of a temperature control device, not illustrated, in order to maintain the temperature of the melt at a desired constant level.

An important feature of the present invention is the provision of control structure for maintaining the free melt level 12 of the molten metal at a constant level within the furnace chamber. Thus, in the arrangement shown in FIG. 1, such control structure includes a liquid-level displacement float 14 extending into the molten metal within the furnace chamber. Drive means 15 is operably associated with the float 14 for raising or lowering the float 14 and for thereby varying the degree of extension of the float into the molten material. Drive 15 is shown only schematically and may be any known mechanical arrangement for providing linear movement of float 14, such as a rack and pinion arrangement, a worm arrangement, a servo-motor, etc. A level detector 13 extends into the furnace chamber and detects the level of the free melt level 12 of the molten metal and generates a signal representative of such detected level. This signal is transmitted to a regulator, shown schematically at 16, which is connected to drive 15. Regulator 16 may be any known device which is capable of receiving a signal and transducing such signal into a drive signal for operating the drive 15. Thus, level detector 13 detects the level of the free melt level 12 and thereby operates drive 15 to vary the degree of extension of float 14 into the molten metal to maintain the free melt level 12 at the desired constant level, for example at a level h measured above the plane of the sliding gate valve 10, as depicted in FIG. 1. That is, during discharge of molten metal through outlet channel 7 and sliding gate valve 10, the free melt level 12 will tend to lower. Such, however, will be detected by probe 13 which will cause drive 15 to lower float 14 into the molten metal, thereby increasing the displacement of molten metal and raising the free melt level 12 back to the desired constant level. Similarly, when additional molten metal is added to the furnace chamber, for example via charging chamber 4, the free melt level 12 will tend to rise. This however will also be detected by probe 13 which will cause drive 15 to raise the float 14, thereby decreasing the displacement of molten metal and again lowering the level of the free melt level 12 back to the desired constant level.

Due to the fact that the free melt level 12 is always maintained at a constant level, the metallostatic or hydrostatic pressure of the molten metal, at least the molten metal above the outlet channel 7, will be maintained at a constant value. Therefore, desired measured quantities of the molten metal may be discharged through outlet channel 7 and sliding gate valve 10 by simply controlling the period of time during which the sliding gate valve 10 is open. Accordingly, in accordance with the present invention, there is also provided regulating structure, operable independently of the operation of the level control structure, for operating the sliding gate valve between the closed and open positions thereof at a predetermined timed cycle. In the illustrated arrangement, the sliding plate of the sliding gate valve is operated by a conventional gate drive 17, the operation of which is controlled by a time control device 18 which may be any known type device capable of operating a mechanical drive such as gate drive 17 in timed cycles.

Accordingly, at a given free melt level 12, and at a constant temperature and viscosity of the molten metal, the quantity of molten metal discharged per unit time will be determined by the smallest cross-sectioned opening among the openings of the various elements of sliding gate valve 10 and outlet channel 7. Such smallest cross-sectioned element will normally be discharge nozzle 11 of the sliding gate valve 10. That is, outlet channel 7 and the openings through the various plates of the sliding gate valve 10 will be larger than the bore of the discharge nozzle 11.

The measured quantity of the molten metal discharged through outlet channel 7 and sliding gate valve 10 may be poured into a suitable casting device, such as a casting mold 36 which may be mounted on a conveyor device 37, for example a roller track. However, it will be apparent that other casting devices may be similarly employed, such as the casting molds of a carrousel type casting device, a belt conveyor for pig castings, or a die-casting machine having casting chambers. Also, it would be possible to provide a furnace having a plurality of pouring spouts 6, each having an associated sliding gate valve 10 to be independently operable to discharge into a suitable mold or casting arrangement.

The discharge nozzle preferably is interchangeable with other discharge nozzles having different size bores to adjust the quantity of molten metal discharged during a given time cycle. Additionally, however it will be apparent that such adjustment may be achieved by operating the sliding gate valve 10 such that the opening in the sliding plate thereof is only partially open, i.e. in a throttled position. Also however, it would be possible to vary the quantity of molten metal discharged by varying the time of opening of the sliding gate valve during a given casting cycle. It is of course to be understood that the time control of the operation of the sliding gate valve 10 may be coordinated with the movement or position of the casting mold 36 or of the cycle of a die-casting machine.

It will be apparent that the baffles 3 extend somewhat above the free melt level 12 and operate during relative extension of float 14 into the molten metal and during the addition of additional molten metal into the charging chamber 4, to prevent agitation or the formation of waves on the upper surface of the molten metal. This helps to avoid any erroneous detection of a change of the level of the free melt level 12.

Figure 2:
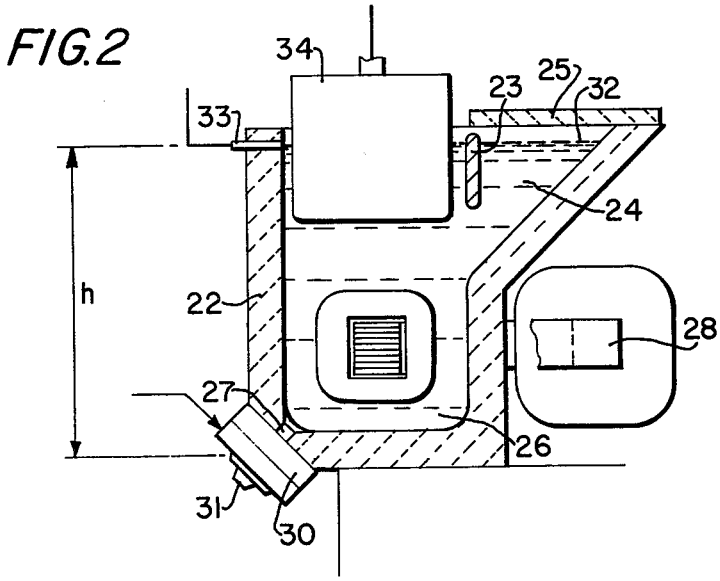
FIG. 2 is a view similar to FIG. 1 but illustrating a furnace and device according to a further embodiment of the present invention.

With reference now to FIG. 2 of the drawings, a somewhat modified arrangement of the device and furnace of the present invention will be described. In this arrangement, an induction furnace 22 is heated by means of a channel-type inductor heating arrangement 28 and includes an inductor channel 26. The furnace interior includes a lateral charging chamber 24 partially sectioned off by a partition 23 in a manner similar to charging chamber 4 and partition 3 of FIG. 1. Lid 25 operates in a manner similar to lids 5 of FIG. 1. An output channel 27 extends through the lining or wall of the furnace from the lowest point of the furnace chamber therein, for example at a "corner" of the inductor channel 26. A sliding gate valve 30 is attached to the furnace adjacent the outlet channel 27 in a manner similar to sliding gate valve 10 of FIG. 1. Sliding gate valve 30 includes a discharge nozzle 31 similar to discharge nozzle 11 of FIG. 1. The free melt level 32 of the molten metal is controlled to be constant in a manner similar to that of the embodiment of FIG. 1. In FIG. 2, for purposes of simplicity of illustration, only float 34 and level detector 33 are illustrated. However, the remainder of the level control structure will be similar to that of the illustrated embodiment of FIG. 1, or any of the possible structural variations thereof. It would be possible, in the arrangement of FIG. 2, to provide channel 27 with the emptying and maintenance opening which is normally provided in the inductor channel of an induction furnace, since the sliding gate valve 30 is detachably fastened to the furnace 22, and since therefore the channels 27 and 26 would be freely accessible. Additionally, it would be possible to modify the structural arrangement shown in FIG. 2 to provide a closed pouring spout, similar to spout 6 of FIG. 1, to project laterally from furnace 22 as a continuation of inductor channel 26, with outlet 27 and sliding gate valve 30 being provided at the under side of such spout.

By the above described and illustrated arrangements of the present invention, it is possible to achieve an accurate discharge of measured quantities of molten metal, particularly non-ferrous metals, from a furnace, particularly such accurate discharge of relatively small quantities of molten metal to be cast and under conditions of rapid casting cycles. It is possible to achieve such advantageous features with a relatively small expenditure on construction and control equipment.

Although the present invention has been described and illustrated in detail with respect to preferred features thereof, it is to be understood that the scope of the present invention is not intended to be limited to such specifically described and illustrated structural features.

For example, in the illustrated embodiments, the level control is achieved by means of a float 14, 34. However, the level control could be achieved by additional arrangements, such as an arrangement to displace the melt by means of compressed gas, or by the measured addition of metal to the furnace, for example metal to be smelted in the furnace. Additionally, it will be understood that various known structural devices may be employed for level detector 13, regulator 16 and drive 15, as long as such devices are capable of achieving the obvious intended functions described herein. The drive 17 for the sliding gate valve and the timing device 18 may also be any known such structure capable of achieving the intended functions described herein.

It will be apparent that in accordance with the present invention severe demands are not placed upon the accuracy and speed of the level control structure. This is particularly true as long as the measured quantity of molten metal to be discharged is small compared to the overall capacity of the furnace. With a relatively large melt surface, all areas of the furnace being connected to each other, only slight or slow fluctuations are produced in the level 12, and the upper surface of the molten metal is maintained calm. This is aided by the provision of partitions 3, 23. In this regard, it should be emphasized that in accordance with known principles of fluid flow, the quantity of fluid discharged is not change in direct proportion with fluctuations of the level of the melt, but only with the square root of such level fluctuations.

By the arrangement of the present invention as described above, precisely measured quantities of molten metal may be discharged without the conventional monitoring of a changing level of the molten metal within the furnace or the casting mold, or without the normal weighing of the melt. Also, it is possible to totally avoid the inclusion of impurities in the casting mold, since discharge of the molten metal takes place beneath the surface of the melt and under calm discharge conditions, such that impurities from the top surface of the melt cannot be discharged.

It will further be apparent that the present invention may be employed with a large number of types and designs of furnaces. In the case of a holding furnace, charging with fresh melt can take place from a separate melt batch, where the furnace can be combined with an attached melting chamber in which smelting of the metal takes place more or less continuously. The present invention may be applied to all types of molten metals, and is particularly useful for casting non-ferrous metals, either heavy or light metals, wherein smooth flow within the furnace and slag-free tapping of the melt beneath the bath surface offer particular advantages.

I claim:

1. A furnace, such as a holding or smelting furnace, for discharging separate measured quantities of molten metal during successive discharge periods, said furnace comprising:

a furnace chamber adapted to contain therein molten metal having a free melt level exposed to substantially atmospheric pressure;

melt outlet means, extending from said chamber at a level below said free melt level, for allowing discharge of said molten metal downwardly from said chamber due to the hydrostatic pressure of said molten metal;

sliding gate valve means, mounted adjacent said melt outlet means, for covering and uncovering said melt outlet means to thereby respectively block and unblock said discharge of molten metal from said chamber;

regulating means for operating said sliding gate valve means between blocking and unblocking positions thereof at a predetermined time cycle, thereby defining separate, successive periods of discharge of said molten metal from said furnace chamber; and control means, operable independently of the operation of said regulating means, for maintaining said free melt level at a constant level above said melt outlet means during discharge therefrom of said molten metal, and thereby for ensuring the discharge of said molten metal at a controlled uniform flow rate during each of said separate, successive discharge periods.

2. A furnace as claimed in claim 1, wherein said control means maintains said hydrostatic pressure of said molten metal within said furnace chamber at a substantially constant value during said discharge.

3. A furnace as claimed in claim 2, wherein said control means comprises a liquid-level displacement float extending into said molten metal within said furnace chamber, drive means connected to said float for varying the degree of extension of said float into said molten metal, and level detecting means positioned within said furnace chamber for detecting the level of said free melt level and connected to said drive means for initiating operation thereof as a function of the level detected by said level detecting means, to thereby vary said degree of extension of said float into said molten metal to maintain said free melt level at said constant level.

4. A furnace as claimed in claim 3, further comprising baffle means within said molten metal in said furnace chamber for preventing agitation of said free melt level during variation of the degree of extension of said float into said molten metal.

5. A furnace as claimed in claim 1, comprising a furnace lining defining said furnace chamber.

6. A furnace as claimed in claim 5, wherein said furnace comprises an electric resistance heated furnace, and said furnace lining has therein electric resistance heating means.

7. A furnace as claimed in claim 1, wherein said sliding gate valve means includes means for varying the size of the discharge opening thereof.

8. A furnace as claimed in claim 7, wherein said varying means comprises interchangeable discharge nozzles of different size.

9. A furnace as claimed in claim 1, wherein said furnace comprises an induction furnace having a channel-type inductor heating means.

10. A furnace as claimed in claim 1, wherein said furnace has extending from a side thereof a pouring spout having a floor, and said melt outlet means and said sliding gate valve means are arranged at said floor.

11. A furnace as claimed in claim 1, wherein said melt outlet means and said sliding gate valve means are arranged at the base of said furnace chamber.

12. A furnace as claimed in claim 1, wherein said melt outlet means comprises a channel extending through a furnace wall defining said furnace chamber.

13. A furnace as claimed in claim 1, wherein said regulating means comprises gate drive means for driving said sliding gate valve means, and timing means for controlling operation of said gate drive means at said predetermined time cycle.

14. A furnace, such as a holding or smelting furnace, for discharging separate measured quantities of molten metal, particularly non-ferrous molten metal, during successive discharge periods, said furnace comprising:

a furnace wall defining a furnace chamber adapted to contain therein molten metal having an upper free melt level exposed to substantially atmospheric pressure;

at least one melt outlet channel extending from said furnace chamber through said furnace wall at a level below said free melt level;

a sliding gate valve mounted on said furnace wall at said outlet channel and movable between a closed position, blocking said outlet channel and preventing discharge of said molten metal therethrough, and an open position, unblocking said outlet channel and allowing discharge of said molten metal downwardly therethrough due to the hydrostatic pressure of said molten metal;

regulating means for operating said sliding gate valve between said closed and open positions thereof at a predetermined timed cycle, thereby defining separate, successive periods of discharge of said molten metal from said furnace chamber; and control means, operable independently of the operation of said regulating means, for maintaining said free melt level at a constant level above said outlet channel, thereby for maintaining said hydrostatic pressure of said molten metal within said furnace chamber at a constant value during discharge of said molten metal, and thereby for ensuring the discharge of said molten metal at a controlled uniform flow rate during each of said separate, successive discharge periods.

15. A device for discharging separate measured quantities of molten metal during successive discharge periods from a furnace having a furnace chamber and a melt outlet extending from the chamber at a level below molten metal therein, said device comprising:

sliding gate valve means, adapted to be mounted adjacent the melt outlet of the furnace, for covering and uncovering the melt outlet and for thereby respectively blocking and unblocking the discharge of molten metal downwardly from the furnace chamber due to the hydrostatic pressure of the molten metal;

regulating means for operating said sliding gate valve means between blocking and unblocking positions thereof at a predetermined time cycle, thereby defining separate, successive periods of discharge of molten metal from the furnace chamber; and control means operable independently of the operation of said regulating means, for maintaining the free melt level of molten metal within the furnace chamber at a constant level above the melt outlet during discharge of the molten metal, and thereby for ensuring the discharge of the molten metal at a controlled uniform flow rate during each of said separate, successive discharge periods.

16. A device as claimed in claim 15, wherein said control means maintains said hydrostatic pressure of the molten metal within the furnace chamber at a constant value during said discharge.

17. A device as claimed in claim 16, wherein said control means comprises a liquid-level displacement float adapted to extend into the molten metal within the furnace chamber, drive means connected to said float for varying the degree of extension of said float into the molten metal, and level detecting means adapted to be positioned within the furnace chamber for detecting the level of the free melt level and connected to said drive means for initiating operation thereof as a function of the level detected by said level detecting means, to thereby vary said degree of extension of said float into the molten metal to maintain the free melt level at said constant level.

18. A device as claimed in claim 17, further comprising baffle means adapted to be positioned within the molten metal in the furnace chamber for preventing agitation of the free melt level during variation of the degree of extension of said float into the molten metal.

19. A device as claimed in claim 15, wherein said sliding gate valve means includes means for varying the size of the discharge opening thereof.

20. A device as claimed in claim 19, wherein said varying means comprises interchangeable discharge nozzles of different size.

21. A device as claimed in claim 15, wherein said regulating means comprises gate drive means for driving said sliding gate valve means, and timing means for controlling operation of said gate drive means at said predetermined cycle.

22. A device for discharging separate measured quantities of molten metal, particularly non-ferrous molten metal, during successive discharge periods from a furnace, such as holding or smelting furnace, having a furnace wall defining a furnace chamber adapted to contain therein molten metal having an upper free melt level exposed to substantially atmospheric pressure, and at least one melt outlet channel extending from the furnace chamber through the furnace wall at a level below the free melt level, said device comprising:

a sliding gate valve adapted to be mounted on the furnace wall at the outlet channel and movable between a closed position, for blocking the outlet channel and for preventing discharge of the molten metal therethrough, and an open position, for unblocking the outlet channel and allowing discharge of the molten metal downwardly therethrough due to the hydrostatic pressure of the molten metal;

regulating means for operating said sliding gate valve between said closed and open positions thereof at a predetermined timed cycle, thereby defining separate, successive periods of discharge of molten metal from the furnace chamber; and control means, operable independently of the operation of said regulating means, for maintaining the free melt level at a constant level above the outlet channel, thereby for maintaining the hydrostatic pressure of the molten metal within the furnace chamber at a constant value during discharge of the molten metal, and thereby for ensuring the discharge of the molten metal at a controlled uniform flow rate during each of said separate, successive discharge periods.

* * * * *